United States Patent [19]

Pallien

[11] Patent Number: 4,887,495

[45] Date of Patent: Dec. 19, 1989

[54] METHOD OF MANUFACTURING A DOUBLE-EDGED PEELING KNIFE

[75] Inventor: Wilhelm Pallien, Huettingen/Kyll, Fed. Rep. of Germany

[73] Assignee: Alfred Boerner GmbH, Fed. Rep. of Germany

[21] Appl. No.: 256,460

[22] Filed: Oct. 12, 1988

[30] Foreign Application Priority Data

Oct. 13, 1987 [DE] Fed. Rep. of Germany ..... 3734641

[51] Int. Cl.[4] ..... B21D 53/64

[52] U.S. Cl. ..... 76/104 R; 76/101 SM

[58] Field of Search ..... 76/104 R, 101 R, 101 SM

[56] References Cited

U.S. PATENT DOCUMENTS 934,840 9/1909 Ross ..... 76/104 R 2,056,408 10/1936 Ohmer ..... 76/104 R

*Primary Examiner*—Roscoe V. Parker

*Attorney, Agent, or Firm*—Hill, Van Santen, Steadman & Simpson

[57] ABSTRACT

A method for manufacturing a double-edge peeling knife blade which includes the steps of providing a strip of steel which is sharpened along each edge to form blade portions, punching notches out of the strip steel to leave blade blanks interconnected by a connecting web, punching out a central region to form an aperture having a width greater than half the width of the strip of steel and a length less than the length of the blade blank to leave bridging sections interconnecting the blade portions, then bending the blade portions at right angles to the blade blank, bending the bent blade portions a second time to overlap a portion of the aperture, parting the connecting web and forming the blank into an arcuate configuration. Preferably, this strip is sequentially processed as it is moved in a step-like manner through the processing dies and punches.

7 Claims, 1 Drawing Sheet

30

31

12
14

20
12
14

L
A
A
B
B
C
C
D
D
10
40
12
50
16
26
20
24
22
18
14
41

L
60
14

METHOD OF MANUFACTURING A DOUBLE-EDGED PEELING KNIFE

BACKGROUND OF THE INVENTION

The present invention is directed to a method for manufacturing a two-sided peeling knife.

Two-sided peeling knives are used in various ways in a household, for example for peeling vegetables or the like.

Known peeling knives are formed by punching and shaping and, subsequently, fashioning of the blades by grinding. This known method is rather involved.

SUMMARY OF THE INVENTION

The object of the present invention is to create a method for manufacturing a double-edged peeling knife that is less involved and, thus, less expensive.

This object is achieved by a method in which a strip of steel is provided and has both sides sharpened to form blade portions along each side of the strip. This strip is then sequentially passed through a series of steps, which include punching parting notches from the strip while leaving an interconnecting web, punching a central region from the strip of steel which has a width greater than half the width of the strip but leaves the sharpened blade portions and has a length which is less than the feed length for each step to leave a bridging portion at each end adjacent the connecting web, then bending the remaining blade portions in a first bending step, bending the blade portions a second time back against the center portion of the strip and overlapping the punched out central region and then subsequently cutting the connecting webs and shaping the folded element into an arcuate cross section. Preferably, these are done with the steps following one after another as the strip steel is passed through a series of shaping apparatus having the appropriate punching dies and bending dies.

DESCRIPTION OF THE PREFERRED EMBODIMENTS

Figures 1, 2, 3A, 3B, 3C, 3D:
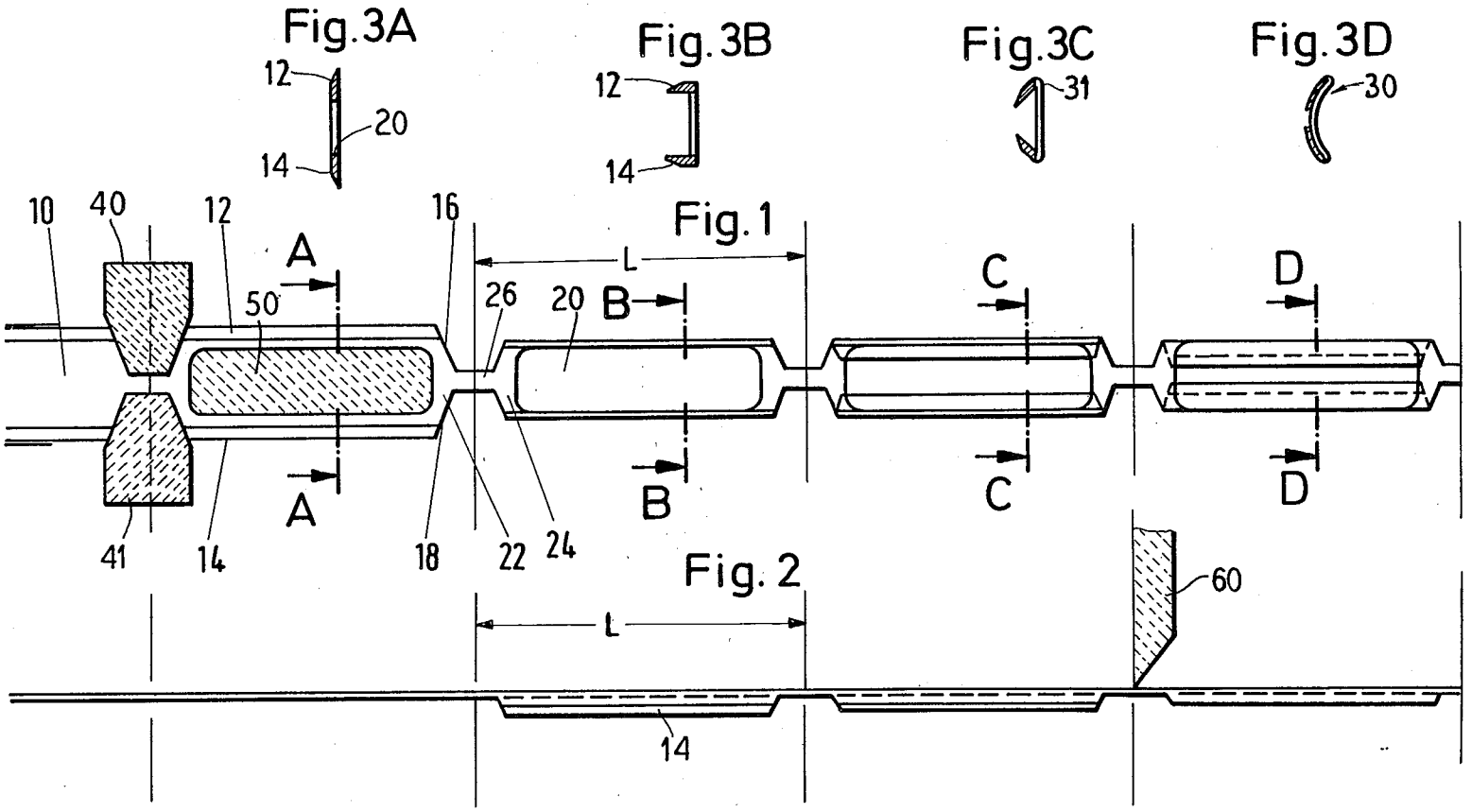
FIG. 1 is a plan view of the strip of steel being processed in accordance with the present invention in a step-like manner.
FIG. 2 is a side view of the strip of steel as it progresses through the various processing steps illustrated in FIG. 1.
FIG. 3A is a cross sectional view taken along the lines A—A of FIG. 1.
FIG. 3B is a cross sectional view taken along the lines B—B of FIG. 1.
FIG. 3C is a cross sectional view taken along the lines C—C of FIG. 1.
FIG. 3D is a cross sectional view taken along the lines D—D of FIG. 1.

The principles of the present invention are particularly useful when used to form a two-sided peeling knife blade, such as the blade 30 illustrated in FIG. 3D.

To form the two-sided or double edged peeling knife blade 30, a strip 10 of steel having a width, for example, of 20 mm is ground on both edges to form blade portions 12 and 14. This strip 10 is advanced in a step-like fashion with the amount of feed per step being L and being, for example, 57 mm. In the first step, appropriately fashioned dies, such as 40 and 41, are used to form notches 16 and 18 along the side of the strip. In addition, a punching die arrangement 50 is used to punch out an oblong recess or aperture 20 from the center of the strip while in the first station. The aperture or recess 20 has a width which is larger than half the width of the strip 10 and amounts to approximately 14 mm in the illustrated embodiment. The length of the rectangular aperture 20 is selected so that bridge sections 22 and 24 remain between the recess and the connecting notches, such as 16 and 18. The bridge sections 22 and 24 extend essentially at right angles relative to the conveying direction and a connecting web 26 remains when the parting notches 16 and 18 have been punched in the side of the strip. This connecting web 26 interconnects adjacent portions or blanks of the strip.

In the next working step, the blade portions 12 and 14 are bent downward at right angles to the plane of the strip by an appropriate die arrangement to form the view illustrated in FIG. 3B. In the next following working step, the bent edges are bent over or back onto the remaining portions of the st rip, such as the bridge portions 22 and 24, so that they overlie a portion of the aperture 20 and form a fold blank 31 (FIG. 3C). Subsequently, in the following step a punch 60 is used to sever the connecting web 26 to form the individual peeling knife blanks. These individual blanks are then shaped into the desired arcuate cross sectional shapes, such as illustrated by the blank 30 in FIG. 3D.

The proposed method for the manufacturing of the double-edge peeling knife is far less involved than those methods which have herebefore been used, since it no longer requires the grinding of the blades after the working or shaping steps.

It should be noted that the preferred embodiment of the method has been described as processing the blanks from a sheet of steel as it is passing through a series of working stations in a sequential manner.

Although various minor modifications may be suggested by those versed in the art, it should be understood that I wish to embody within the scope of the patent granted hereon all such modifications as reasonably and properly come within the scope of my contribution to the art.

I claim:

1. A method for manufacturing a double-edge peeling knife, said method comprising the steps of providing a strip of steel having sharpened edge portions along each side of the strip; punching parting notches in the strip along each edge to form blanks being interconnected by a connecting web, punching out a center region of each blank to form an aperture having a width greater than half the width of the strip while leaving the sharpened blade portions, said aperture having a length which is less than the length of each blank to form a bridge portion and connecting the web at each end of the blank; bending the sharpened blade portions relative to the remaining portion of the blank; bending the blade portions over onto the remaining portion of the blank severing the connecting web and deforming the bridge sections and the blank into an arcuate configuration.

2. A method according to claim 1, wherein the step of providing the strip of steel provides a strip of steel in a sequential step feed with the amount of feed determining the length of the blank.

3. A method according to claim 2, wherein the step of parting the connecting web and deforming the blank into an arcuate configuration is done simultaneously.

4. A method for manufacturing a double-edge peeling knife, said method comprising the steps of providing a strip of steel having both edges sharpened to form sharpened blade portions; sequentially moving said strip of steel in a step-like manner through a given length; punching parting notches out of the strip along each edge to divide the strip into blade blanks interconnected by connecting webs; punching out a center region of each blade blank to form an aperture having a width greater than half the width of the strip and a length less than the length of the blank to leave bridging sections adjacent each end; bending the sharpened blade portions more than 90° so that the sharpened edges of each blade portion overlie a portion of the aperture; parting the connecting web to separate the blanks and deforming the blank into an arcuate configuration.

5. A method according to claim 4, wherein the step of punching to form the parting notches and the punching of the central region is accomplished simultaneously at one station.

6. A method according to claim 4, wherein the step of bending the blade portions is done in two steps with the first step bending the blade portions through an angle of approximately 90° relative to the plane of the blade blank and the second step bends the portion to the position to overlie the aperture.

7. A method according to claim 4, wherein the step of parting the connecting web and deforming the blade blank into an arcuate configuration is accomplished simultaneously.

* * * * *